US006478897B1

(12) United States Patent
Izumida et al.

(10) Patent No.: US 6,478,897 B1
(45) Date of Patent: Nov. 12, 2002

(54) HEAT-RESISTANT ALLOY WIRE

(75) Inventors: Hiromu Izumida, Itami (JP); Nozomu Kawabe, Itami (JP); Sadamu Matsumoto, Itami (JP); Norihito Yamao, Itami (JP); Teruyuki Murai, Itami (JP)

(73) Assignee: Sumitomo Electric Engineering, Ltd., Osaka (JP)

( * ) Notice: Subject to any disclaimer, the term of this patent is extended or adjusted under 35 U.S.C. 154(b) by 0 days.

(21) Appl. No.: 09/786,466

(22) PCT Filed: Jan. 24, 2000

(86) PCT No.: PCT/JP00/00329

§ 371 (c)(1),
(2), (4) Date: Mar. 5, 2001

(87) PCT Pub. No.: WO00/44950

PCT Pub. Date: Aug. 3, 2000

(30) Foreign Application Priority Data

Jan. 28, 1999 (JP) ..... 11-020743

(51) Int. Cl.[7] ..... C22C 19/05
(52) U.S. Cl. ..... 148/428; 148/908; 148/442
(58) Field of Search ..... 420/445, 446, 420/447, 448, 450, 584.1, 585, 586, 586.1; 148/428, 429, 908, 442

(56) References Cited

U.S. PATENT DOCUMENTS 3,859,060 A * 1/1975 Eiselstein et al. ..... 420/448

FOREIGN PATENT DOCUMENTS

| | | |
|---|---|---|
| GB | 1075216 | 7/1967 |
| JP | 48-7173 | 3/1973 |
| JP | 54-6968 | 4/1979 |
| JP | 4-131344 | 5/1992 |
| JP | 7-42560 | 5/1995 |

* cited by examiner

*Primary Examiner*—Deborah Yee
(74) *Attorney, Agent, or Firm*—McDermott, Will & Emery

(57) ABSTRACT

An Ni-based or Ni—Co-based heat-resistant alloy wire excellent in resistance to sag at high temperatures ranging from 600 to 700° C., which excellent resistance is most suitable for spring materials. The heat-resistant alloy wire contains (a) 0.01 to 0.40 wt % C, 5.0 to 25.0 wt % Cr, and 0.2 to 8.0 wt % Al; (b) at least one constituent selected from the group consisting of 1.0 to 18.0 wt % Mo, 0.5 to 15.0 wt % W, 0.5 to 5.0 wt % Nb, 1,0 to 10.0 wt % Ta, 0.1 to 5.0 wt % Ti and 0.001 to 0.05 wt % B; (c) at least one constituent selected from the group consisting of 3.0 to 20.0 wt % Fe and 1.0 to 30.0 wt % Co; and (d) the remaining constituent consisting mainly of Ni and unavoidable impurities. The wire has (a) a tensile strength not less than 1,400 N/mm$^2$ and less than 1,800 N/mm$^2$, (b) an average crystal-grain diameter not less than 5 $\mu$m and less than 50 $\mu$m in a cross section, and (c) a crystal-grain aspect ratio (a major-axis/minor-axis ratio) of 1.2 to 10 in a longitudinal section.

3 Claims, 1 Drawing Sheet

HEAT-RESISTANT ALLOY WIRE

TECHNICAL FIELD

Figure 1:
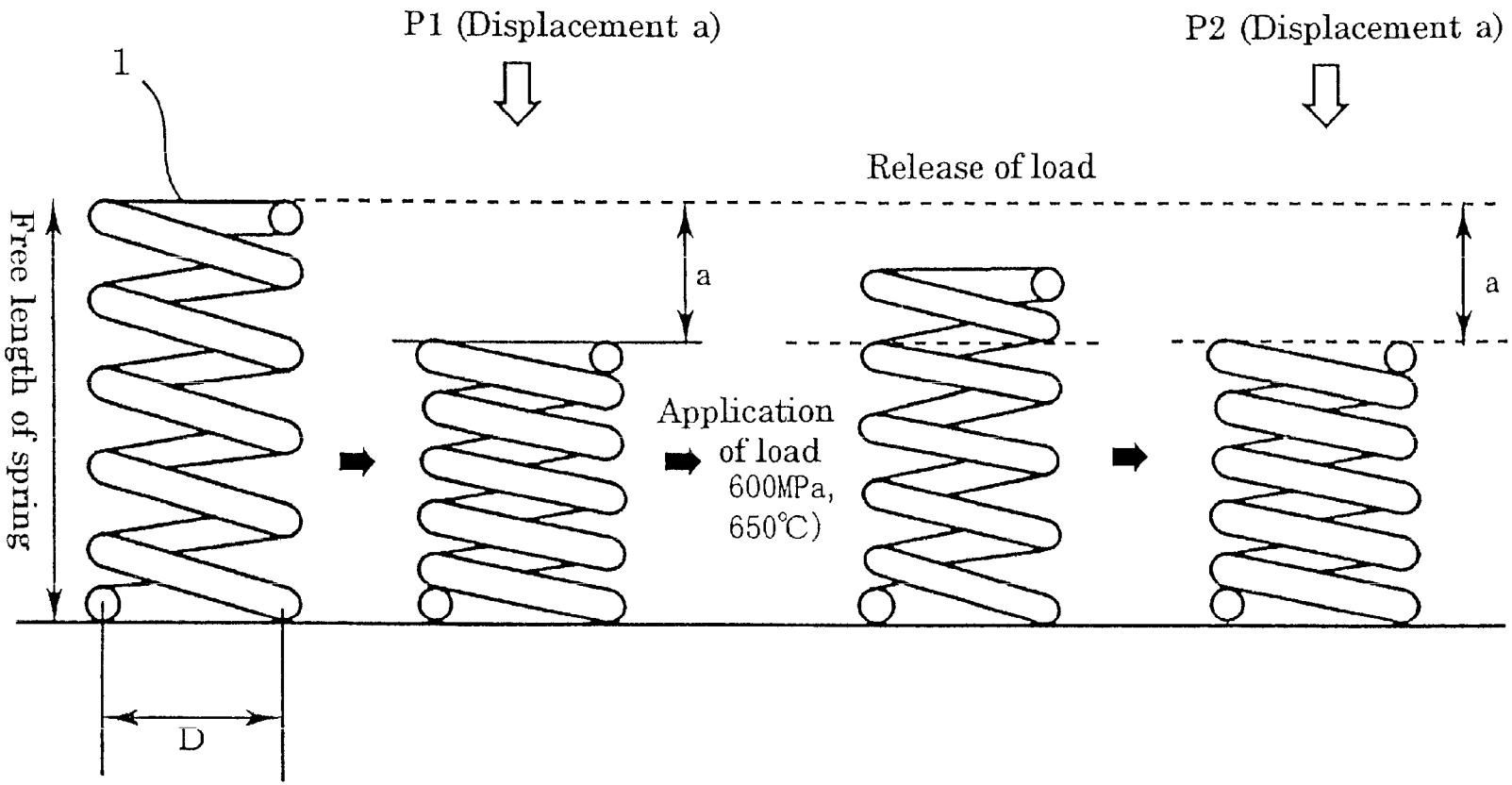

The present invention relates to an Ni-based or Ni—Co-based heat-resistant alloy wire, which has a γ phase (austenite) metal structure, for use mainly as material for springs for various parts that require to have heat-resistant quality, such as engine parts, parts for nuclear power generation, and turbine parts.

BACKGROUND ART

As a material for springs used in gas-exhausting systems for engines of automobiles, austenitic stainless steel conventionally used as heat-resistant steel, such as SUS 304, SUS 316, or SUS 631J1, has been used for operating temperatures ranging from normal temperature to 350° C. An Ni-based heat-resistant alloy, such as Inconel X750 or Inconel 718 (brand names), has been used as material for parts used in temperatures over 400° C.

Recently, there is growing demand for more stringent control of the exhaust gases of automobiles as a measure for environmental protection. The demands have prompted a tendency to raise the temperature of the gas-exhausting systems in order to increase the efficiency of engines and catalysts. As a result, the operating temperature of springs, which thus far, have been usually used at about 600° C., has risen to about 650° C. In this case, even an Ni-based heat-resistant alloy, such as Inconel X750 or Inconel 718, may be insufficient in heat-resistant quality, especially resistance to sag at high temperatures, the resistance of which is particularly required of heat-resistant springs. In such a case, Ni—Co-based heat-resistant alloys, such as Waspaloy and Udimet 700 (brand names), may be taken into consideration as alloys that can be used at the highest temperatures thus far. They do not, however, necessarily have excellent resistance to sag at high temperatures.

The foregoing Ni-based alloy and Ni—Co-based alloy are strengthened alloys in which γ' phases (precipitated phases having $Ni_3A$ as a fundamental form) are intensively precipitated in the γ phase (austenite phase), which acts as a matrix. The structures in the matrix and γ' phase must be controlled to improve the heat-resistant quality.

The published Japanese Patent Application Tokukoushou 48-7173 limits the amounts and ratios of added elements, such as Mo, W, Al, Ti, Nb, Ta, and V, in order to obtain high-temperature strength at temperatures over 600° C.

Another published Japanese Patent. Application, Tokukoushou 54-6968, limits the contents of and added ratios between Mo and W and the contents of and added ratios between Ti and Al in order to obtain high-temperature strength, resistance to corrosion, and resistance to brittle fracture.

However, these inventions focus on improving the heat-resistant quality (mainly high-temperature strength) mainly by controlling the precipitated phase as opposed to improving the resistance to sag at temperatures over 600° C., the resistance of which is required of heat-resistant springs. Alloy wires for heat-resistant springs are produced through the steps of melting, casing, rolling, forging, solution heat treatment, wire drawing, spring formation, and aging heat treatment. The formation of a texture in the matrix (γ phase) and the change in crystal-grain diameter during the above process, also significantly affect the heat-resistant quality of the products.

In view of the above circumstances, the main object of the present invention is to offer a heat-resistant alloy wire with excellent resistance to sag at high temperatures ranging from 600 to 700° C., which is strongly required of spring materials. The excellent resistance to sag is obtained by controlling the crystal-grain diameter of the γ phase, which is the matrix of an Ni-based or Ni—Co-based heat-resistant alloy, and by controlling the precipitation of the γ' phase [$Ni_3$(Al, Ti,Nb,Ta)].

DISCLOSURE OF THE INVENTION

The heat-resistant alloy wire of the present invention has the following features:

(a) It contains 0.01 to 0.40 wt % C, 5.0 to 25.0 wt % Cr, and 0.2 to 8.0 wt % Al.

(b) It contains at least one constituent selected from the group consisting of 1.0 to 18.0 wt % Mo, 0.5 to 15.0 wt % W, 0.5 to 5.0 wt % Nb, 1,0 to 10.0 wt % Ta, 0.1 to 5.0 wt % Ti and 0.001 to 0.05 wt % B.

(c) It contains at least one constituent selected from the group consisting of 3.0 to 20.0 wt % Fe and 1.0 to 30.0 wt % Co.

(d) It has the remainder consisting mainly of Ni and unavoidable impurities.

(e) It has a tensile strength of not less than 1,400 N/mm$^2$ and less than 1,800 N/mm$^2$.

(f) It has an average crystal-grain diameter not less than 5 μm and less than 50 μm in its cross section.

(g) It has a crystal-grain aspect ratio (major-axis/minor-axis ratio) of 1.2 to 10 in a longitudinal section.

The alloy wire of the present invention is mainly used as material for springs. Therefore, after undergoing the wire-drawing process, the wire must be formed into a spring by a coiling process. In consideration of the required tensile strength for the coiling process and the possibility of breakage during the process, the wire is required to have a tensile strength of not less than 1,400 N/mm$^2$ and less than 1,800 N/mm$^2$.

If the crystal-grain aspect ratio is less than 1.2 or more than 10 in a longitudinal section, sufficient resistance to sag at high temperatures cannot be achieved.

In order to further improve the heat-resistant quality, it is desirable that the alloy wire before undergoing the coiling process have an average crystal-grain diameter of not less than 10 μm in its cross section. This lower limit is to decrease the number of grain boundaries so that the total displacement can be reduced when sliding occurs at the grain boundaries. If the average crystal-grain diameter becomes 50 μm or more in a cross section, the tensile strength at room temperature required for the spring formation process cannot be achieved. Hence, the diameter must be less than 50 μm. Here the average crystal-grain diameter in a cross section shows the one in the foregoing γ phase.

In order to control the crystal-grain diameter, it is effective to raise the temperature for the solution heat treatment. Specifically, when the solution heat treatment is carried out at a temperature of not lower than 1,100° C. and lower than 1,200° C., the specified crystal-grain diameter can be obtained easily in a short time. Even if the solution heat treatment is carried out at a temperature of not lower than 1,000° C. and lower than 1,100° C., when the wire drawing is performed at a reduction rate in the area of 5% to 60%, desirably 10% to 20%, an alloy wire excellent in resistance to sag at high temperatures can be obtained.

The alloy wire of the present invention is a heat-resistant alloy wire in which γ' precipitation is intensified. The alloy wire treated by the foregoing control of the crystal-grain diameter is formed into a spring. Subsequently, a proper aging heat treatment is selected and carried out at a temperature of not lower than 600° C. and lower than 900° C. for a period of not less than one hour and less than 24 hours. Thus, the required high heat-resistant quality can be obtained. The γ' phase can be detected through X-ray diffraction.

In the present invention, the selection of the constituent elements and the limitation of the constituting ranges are conducted for the following reasons:

The element C increases the high-temperature strength by combining with Cr and other elements in the alloy to form carbides. However, an excessive amount of C decreases toughness and corrosion resistance. Consequently, 0.01 to 0.40 wt % C is determined as an effective content.

The element Cr is effective to obtain heat-resistant quality and oxidation resistance. First, an Ni equivalent and a Cr equivalent are calculated from the other constituent elements in the alloy wire of the present invention. Then, considering the phase stability of the γ phase (austenite), 5.0 wt % or more Cr is determined to obtain the required heat-resistant quality. In view of the toughness deterioration, 25.0 wt % or less Cr is determined.

The element Al is the principal constituent element of the γ' phase [$Ni_3$(Al,Ti,Nb,Ta)]. It easily forms oxides and is also used as a deoxidizer for melting refinement. An excessive addition of Al, however, easily causes deterioration in hot-working quality. Consequently, 0.2 to 8.0 wt % Al is selected.

The elements Mo and W form a solid solution with the γ phase (austenite) and contribute considerably to the increase in high-temperature tensile strength and resistance to sag. On the other hand, they tend to form TCP phases, such as a σ phase, that decrease creep fracture strength and ductility. In considering the minimum added amount required to improve the resistance to sag and of the deterioration in processibility, 1.0 to 18.0 wt % Mo and 0.5 to 15.0 wt % W are determined.

In the alloy wire of the present invention, γ' phases, namely [$Ni_3$(Al,Ti,Nb,Ta)], are intensively precipitated to improve the heat-resistant quality. The constituting ranges of the constituent elements are limited for the following reasons:

The element Ti is the principal constituent element of the γ' phase [$Ni_3$(Al,Ti,Nb,Ta)]. However, the excessive addition of Ti causes the excessive precipitation of an η phase ($Ni_3Ti$: an hcp structure) at the grain boundaries. As a result, it is unable to control the precipitation of the γ' phase [$Ni_3$(Al,Ti,Nb,Ta)] required to obtain heat-resistant quality by heat treatment only. In order to secure an effective amount of the precipitation, it is necessary to limit the element to 0.1 to 5.0 wt % Ti.

The element Nb precipitates an $Fe_2Nb$ (Laves) phase if excessively added. In order to avoid the resultant strength reduction, 0.5 to 5.0 wt % Nb is determined.

The element Ta is, as with Nb, a ferrite-stabilizing element. Therefore, it deprives the γ phase of its stability if excessively added. In order to avoid excessive precipitation in the grain boundaries, 1.0 to 10.0 wt % Ta is determined.

The element B is added to prevent a hot shortness and increase the toughness in intensively precipitating the γ' phase in order to strengthen the γ phase. For this purpose, 0.001 to 0.05 wt % B is determined.

The elements Co and Fe form a solid solution with Ni and exist in high concentrations in the γ phase. The element Fe is useful for reducing the production cost of alloys. However, it may reduce the amount of precipitation of the γ' phase or form a Laves phase with Nb or Mo. Consequently, 3.0 to 20.0 wt % Fe is determined. The element Co has the following functions:

(a) reducing the stacking-fault energy;

(b) intensifying the solid solution hardening;

(c) raising the temperatures for the solubility limit of the γ' phase in the grain boundaries;

(d) raising the allowable operating temperatures of the alloys;

(e) increasing the amount of precipitation of the γ' phase in the crystal grains; and (f) suppressing the growth of the grains of the γ' phase (the γ' grains) in the crystal grains.

Consequently, 1.0 to 30.0 wt % Co is determined as an effective content.

SIMPLE EXPLANATION OF THE DRAWING

FIG. 1 is a diagram illustrating a test for evaluating resistance to sag. In FIG. 1, the sign "1" signifies a sample.

BEST MODE FOR CARRYING OUT THE INVENTION

Embodiments of the present invention are explained below. The steel products whose chemical compositions are shown in Table 1 were melted and cast with a 150-kg vacuum melting furnace. The cast bodies were forged and hot-rolled to produce wire rods having a diameter of 9.5 mm. The wire rods were subjected to repeated processes of solution heat treatment and wire drawing. The final solution heat treatment was carried out at a diameter of 5.2 mm. The final wire drawing was carried out at a reduction rate in area of 40% to produce test samples having a diameter of 4 mm. Table 1 shows the average crystal-grain diameter in a cross section and the aspect ratio of the crystal grains in a longitudinal section of each test sample.

TABLE 1

Chemical composition, average crystal-grain diameter in a cross section, and crystal-grain aspect ratio in a longitudinal section of the invented materials

| | C | Cr | Al | Mo | W | Nb | Ta | Ti | B | Fe | Co | Ni | Solution-heat-treatment temperature (° C.) | Reduction rate in area (%) |
|---|---|---|---|---|---|---|---|---|---|---|---|---|---|---|
| Example 1 | 0.07 | 20.0 | 1.5 | 4.0 | | | | 3.0 | 0.005 | | 13.5 | Remainder | 1,100 | 98.0 |
| Example 2 | 0.04 | 19.0 | 0.5 | 3.1 | | 5.0 | | 0.9 | | 18.5 | | Remainder | 1,100 | 98.0 |
| Example 3 | 0.04 | 15.0 | 0.8 | | | 0.9 | | 2.5 | | 7.1 | | Remainder | 1,120 | 98.5 |

TABLE 1-continued

Chemical composition, average crystal-grain diameter in a cross section, and crystal-grain aspect ratio in a longitudinal section of the invented materials

| | C | Cr | Al | Mo | W | Nb | Ta | Ti | B | Fe | Co | Ni | Solution-heat-treatment temperature (° C.) | Reduction rate in area (%) |
|---|---|---|---|---|---|---|---|---|---|---|---|---|---|---|
| Example 4 | 0.07 | 18.0 | 2.5 | 3.0 | 1.5 | | | 5.0 | 0.006 | | 15.0 | Remainder | 1,120 | 99.0 |
| Example 5 | 0.15 | 9.0 | 5.5 | 2.5 | 1.0 | | 1.5 | 1.5 | 0.010 | | 10.0 | Remainder | 1,150 | 99.2 |
| Example 6 | 0.05 | 18.0 | 1.5 | | | | | 4.0 | | | 15.0 | Remainder | 1,150 | 97.2 |
| Example 7 | 0.07 | 20.0 | 1.5 | 4.0 | | | | 3.0 | 0.005 | | 13.5 | Remainder | 1,150 | 98.0 |
| Example 8 | 0.04 | 19.0 | 0.5 | 3.1 | | 5.0 | | 0.9 | | 18.5 | | Remainder | 1,150 | 98.0 |
| Example 9 | 0.07 | 20.0 | 1.5 | 4.0 | | | | 3.0 | 0.005 | | 13.5 | Remainder | 1,200 | 98.0 |
| Example 10 | 0.04 | 19.0 | 0.5 | 3.1 | | 5.0 | | 0.9 | | 18.5 | | Remainder | 1,250 | 98.0 |
| Comparative Example 1 | 0.07 | 20.0 | 1.5 | 4.0 | | | | 3.0 | 0.005 | | 13.5 | Remainder | 1,000 | 98.0 |
| Comparative Example 2 | 0.04 | 19.0 | 0.5 | 3.1 | | 5.0 | | 0.9 | | 18.5 | | Remainder | 1,000 | 98.0 |
| Comparative Example 3 | 0.07 | 20.0 | 1.5 | 4.0 | | | | 3.0 | 0.005 | | 13.5 | Remainder | 1,050 | 80.0 |
| Comparative Example 4 | 0.04 | 19.0 | 0.5 | 3.1 | | 5.0 | | 0.9 | | 18.5 | | Remainder | 1,050 | 80.0 |
| Comparative Example 5 | 0.07 | 20.0 | 1.5 | 4.0 | | | | 3.0 | 0.005 | | 13.5 | Remainder | 1,150 | 99.8 |
| Comparative Example 6 | 0.04 | 19.0 | 0.5 | 3.1 | | 5.0 | | 0.9 | | 18.5 | | Remainder | 1,150 | 99.8 |
| Comparative Example 7 | 0.07 | 20.0 | 1.5 | | | | | | | | 13.5 | Remainder | 1,100 | 98.0 |
| Comparative Example 8 | 0.04 | 19.0 | 0.5 | | | | | | | 18.5 | | Remainder | 1,100 | 98.0 |

The crystal-grain diameter in a cross section of a test sample varies with the rolling condition, the solution-heat-treatment condition, and the wire-drawing condition. For these test samples, the crystal-grain diameter was controlled mainly by the temperature of the solution heat treatment. Specifically, the crystal-grain diameters of Examples 1 to 6 and Comparative Examples 3 to 8 were obtained through the solution heat treatment at a temperature as comparatively high as 1,100° C. or higher. This heat treatment utilized the knowledge that the coarsening of the crystal grains at the time of recrystallization of a metal structure is easily promoted in this temperature range. The samples that have a larger grain diameter were produced through the solution heat treatment at a temperature as high as 1,250° C., for example. Various aspect ratios of the crystal grains in a longitudinal section were obtained mainly by properly selecting the reduction rate in area (80 to 99.9%) in the rolling process, because the wire-drawing condition was fixed. The aging condition was fixed for all samples: 750° C. for eight hours.

Test 1

The above-described heat-resistant alloy wire resistance to sag at high temperatures was evaluated. The coil springs produced had a wire diameter of 4.0 mm, an average coil diameter of 22.0 mm, the number of effective turn of 4.5, and a spring free length of 50.0 mm. The test method is shown in FIG. 1. Sample 1 having the form of a coil spring was subjected to a compressive load (the shear stress of the load was 600 MPa) and kept at a test temperature of 650° C. for 24 hours at this load. The residual shear strain was calculated by the method described below. A spring material having a smaller value of the residual shear strain is judged to be a spring material that has a higher resistance to sag at high temperatures. Table 2 shows the magnitudes of the residual shear strains (%) after the test.

The residual shear strain (%) was calculated by the following formula:

$$8/\pi\times(\mathbf{P1}-\mathbf{P2})\times D/(G\times d^3)\times 100,$$

where d (mm): wire diameter;

D (mm): average coil diameter;

P1 (N): load producing a stress of 600 MPa, which load was measured at room temperature (a (mm): the displacement of the coil spring when the load P1 was applied before the test at 650° C.);

P2 (N): load applied to obtain the displacement a (mm) after the test at 650° C., which load was measured at room temperature; and G: modulus of rigidity.

TABLE 2

Resistance to sag at high temperatures (residual shear strain) of the invented materials (600-N/mm$^2$ load at 650° C. for 24 hours)

| | Crystal-grain Diameter (μm) | Aspect ratio | Tensile strength (N/mm$^2$) | Residual shear strain (650° C.) (%) |
|---|---|---|---|---|
| Example 1 | 7.2 | 1.56 | 1,680 | 0.36 |
| Example 2 | 7.3 | 1.57 | 1,572 | 0.37 |

TABLE 2-continued

Resistance to sag at high temperatures (residual shear strain) of the invented materials (600-N/mm$^2$ load at 650° C. for 24 hours)

| | Crystal-grain Diameter (μm) | Aspect ratio | Tensile strength (N/mm$^2$) | Residual shear strain (650° C.) (%) |
|---|---|---|---|---|
| Example 3 | 6.9 | 3.45 | 1,701 | 0.32 |
| Example 4 | 7.5 | 4.21 | 1,613 | 0.34 |
| Example 5 | 7.1 | 8.23 | 1,746 | 0.30 |
| Example 6 | 7.2 | 8.40 | 1,720 | 0.31 |
| Example 7 | 15.1 | 1.56 | 1,637 | 0.28 |
| Example 8 | 17.3 | 1.57 | 1,621 | 0.29 |
| Example 9 | 25.3 | 1.58 | 1,531 | 0.24 |
| Example 10 | 44.5 | 1.56 | 1,421 | 0.20 |
| Comparative Example 1 | 3.2 | 1.58 | 1,734 | 0.45 |
| Comparative Example 2 | 2.4 | 1.56 | 1,621 | 0.47 |
| Comparative Example 3 | 7.1 | 1.02 | 1,648 | 0.51 |
| Comparative Example 4 | 6.8 | 1.01 | 1,592 | 0.45 |
| Comparative Example 5 | 7.5 | 12.0 | 1,721 | 0.44 |
| Comparative Example 6 | 6.8 | 12.5 | 1,631 | 0.46 |
| Comparative Example 7 | 7.4 | 1.60 | 1,432 | 0.60 |
| Comparative Example 8 | 7.7 | 1.58 | 1,423 | 0.70 |

As can be seen from Table 2, Examples 1 to 6 have a small residual shear strain, indicating that they are excellent in resistance to sag at high temperatures. In particular, Examples 7 to 10, which have an average crystal-grain diameter not less than 10 μm and less than 50 μm in a longitudinal section of the wire, have a particularly small residual shear strain. This result demonstrates that an increase in average crystal-grain diameter heightens the resistance to sag at high temperatures.

As opposed to this, the following Comparative Examples have a large residual shear strain, indicating poor resistance to sag at high temperatures:

(a) Comparative Examples 1 and 2, which have a small average crystal-grain diameter in a longitudinal section;

(b) Comparative Examples 3 and 4, which have an excessively small aspect ratio of the crystal grains in a cross section; and (c) Comparative Examples 5 and 6, which have an excessively large aspect ratio of the crystal grains in a cross section.

Comparative Examples 7 and 8, which contain none of Mo, W, Nb, Ta, Ti, and B in their composition, have not only a large residual shear strain but also low tensile strength.

Test 2

Next, alloy wires having the same composition as in Examples 1 and 2 were produced under a varied rolling condition, solution-heat-treatment condition, or reduction rate in area in the wire-drawing process in order to examine the influence of these conditions on the resistance to sag at high temperatures. Table 3 shows these conditions and the results of the examination. In Table 3, Examples 11, 12, and 13 have the same composition as Example 1, and Examples 14, 15, and 16 have the same composition as Example 2.

TABLE 3

Rolling temperature, solution-heat-treatment temperature, reduction rate in area in the wire-drawing process, and heat-resistant qualities of the invented materials

| | Rolling temperature (° C.) | Solution-heat-treatment temperature (° C.) | Reduction rate in area (%) | Crystal-grain diameter (μm) | Aspect ratio | Tensile strength (N/mm$^2$) | Residual shear strain (650° C.) (%) |
|---|---|---|---|---|---|---|---|
| Example 11 | 1,250 | 1,050 | 80 | 6.1 | 1.56 | 1,697 | 0.39 |
| Example 12 | 1,150 | 1,150 | 80 | 6.5 | 1.57 | 1,657 | 0.34 |
| Example 13 | 1,050 | 1,050 | 20 | 6.3 | 1.58 | 1,649 | 0.31 |
| Example 14 | 1,250 | 1,050 | 80 | 6.9 | 1.68 | 1,588 | 0.38 |
| Example 15 | 1,150 | 1,150 | 80 | 7.1 | 1.54 | 1,564 | 0.33 |
| Example 16 | 1,050 | 1,050 | 20 | 7.1 | 1.58 | 1,549 | 0.31 |

As can be seen from the magnitude of residual shear strain (%) in Table 3, the invented materials have high resistance to sag at high temperatures. An increase in rolling temperature, an increase in solution-heat-treatment temperature, and a decrease in reduction rate in area significantly influence the control of the crystal-grain diameter (i.e., coarsening). Consequently, even when manufacturing facilities have some limitations, a proper selection of these conditions enables the production of the alloy wire of the present invention, which has high resistance to sag at high temperatures. Specifically, when a γ phase (austenite) has a low phase stability at high temperatures, that is, when the rolling and solution heat treatment cannot be carried out at a temperature as high as 1,100° C. or higher, a decrease in reduction rate in area during the wire drawing from 5% to 60%, desirably 10% to 20%, enables the attainment of a comparably high resistance to sag at high temperatures.

INDUSTRIAL APPLICABILITY

As is stated above, the present invention offers a heat-resistant alloy wire excellent in resistance to sag at high temperatures ranging from 600 to 700° C., which excellent resistance is most required of spring materials. The excellent resistance is obtained by controlling the crystal grain diameter of the γ phase, which is the matrix of an Ni-based or Ni—Co-based heat-resistant alloy, and by controlling the precipitation of the γ' phase [$Ni_3$(Al,Ti,Nb,Ta)]. Furthermore, the limitation of the aging condition, the solution-heat-treatment condition, and the reduction rate in area during the wire drawing enables the attainment of a more enhanced resistance to sag at high temperatures. Because the heat-resistant alloy wire of the present invention is excellent in resistance to sag at high temperatures ranging from 600 to 700° C., the wire is suitable as a material of heat-resistant springs for parts used at comparatively high temperatures, for example, the parts used in the gas-exhausting systems of automobiles, such as ball joints and blades as the flexible joint parts, knittedwire-mesh springs for supporting three-way catalysts, and return valves for selecting the capacity of exhaust mufflers. Therefore, the heat-resistant alloy wire of the present invention has high industrial value.

What is claimed is:

1. A heat-resistant alloy wire having:

(a) 0.01 to 0.40 wt % C, 5.0 to 25.0 wt % Cr, and 0.2 to 8.0 wt % Al in its chemical composition;

(b) at least one constituent selected from the group consisting of 1.0 to 18.0 wt % Mo, 0.5 to 15.0 wt % W, 0.5 to 5.0 wt % Nb, 1.0 to 10.0 wt % Ta, 0.1 to 5.0 wt % Ti and 0.001 to 0.05 wt % B;

(c) at least one constituent selected from the group consisting of 3.0 to 20.0 wt % Fe and 1.0 to 30.0 wt % Co;

(d) the remaining constituent consisting mainly of Ni and unavoidable impurities;

(e) a tensile strength not less than 1,400 $N/mm^2$ and less than 1,800 $N/mm^2$;

(f) an average crystal-grain diameter not less than 5 μm and less than 50 μm in a cross section; and (g) a crystal-grain aspect ratio (a major-axis/minor-axis ratio) of 1.2 to 10 in a longitudinal section.

2. The heat-resistant alloy wire as defined in claim 1, wherein the average crystal-grain diameter in a cross section is not less than 10 μm and less than 50 μm.

3. The heat-resistant alloy wire as defined in claim 1, the wire being for spring-forming use.

* * * * *